United States Patent [19]

Reesen

[11] 4,214,831

[45] Jul. 29, 1980

[54] APPARATUS FOR PRODUCING DUPLEX COPIES

[75] Inventor: Jorgen Reesen, Pittsford, N.Y.

[73] Assignee: Eastman Kodak Company, Rochester, N.Y.

[21] Appl. No.: 921,287

[22] Filed: Jul. 3, 1978

[51] Int. Cl.[2] ..... G03G 15/00

[52] U.S. Cl. ..... 355/3 R; 271/184; 271/196; 271/DIG. 9; 355/24

[58] Field of Search ..... 355/3 R, 3 BE, 14, 16, 355/24, 26; 271/9, 65, 184, 196, DIG. 9

[56] References Cited

U.S. PATENT DOCUMENTS

| | | | |
|---|---|---|---|
| 3,687,539 | 8/1972 | Furuichi | 355/3 R X |
| 3,883,911 | 9/1974 | Caldwell et al. | 355/24 X |
| 3,941,374 | 3/1976 | Vits | 271/196 X |
| 3,997,263 | 12/1976 | Stemmle | 355/24 |
| 4,019,731 | 4/1977 | Vits | 271/196 X |
| 4,095,979 | 6/1978 | DiFrancesco et al. | 355/26 X |

*Primary Examiner*—Fred L. Braun
*Attorney, Agent, or Firm*—William F. Noval

[57] ABSTRACT

Apparatus for producing copies having images on both sides thereof. The apparatus includes a movable image transfer member, and image forming station for producing first and second unfixed transferable images on the image transfer member and first and second image transfer stations for transferring the images from the image transfer member to a copy sheet. Located between the first and second image transfer stations are a plurality of vacuum rollers including at least a first roller located adjacent to the image transfer member and a guide member associated with the vacuum rollers, the vacuum rollers and guide member forming a copy sheet inversion path. The vacuum rollers are operable in synchronism with the movable image transfer member and are rotatable in a first direction for attracting by vacuum a copy sheet separating from transfer relationship with the transfer member and to one side of which copy sheet the first transferable image has been transferred, and for moving the copy sheet over the guide member along the inversion path away from the transfer member. The vacuum rollers are then rotatable in a second opposite direction after the copy sheet has been separated from the transfer member so as to invert the copy sheet while the first image is unfixed to move the copy sheet over the guide member along the sheet inversion path toward the transfer member to register the second side of the copy sheet with the second image on the transfer member at the image transfer station.

9 Claims, 9 Drawing Figures

APPARATUS FOR PRODUCING DUPLEX COPIES

BACKGROUND OF THE INVENTION

1. Field of the Invention

This invention relates to apparatus for producing duplex copies. More particularly, this invention relates to apparatus for transferring unfixed transferable images to both sides of a copy sheet before fixing of either image to the copy sheet.

2. Description of the Prior Art

Several techniques are known in the prior art for forming duplex images on a final copy medium such as a web or sheet. One such technique requires the use of two photoconductors upon which first and second transferable images are formed respectively. The copy medium is generally passed between the photoconductors and the first and second images are transferred to opposite sides of the copy medium. Another technique similar to the above but involving the use of only one photoconductor, utilizes an intermediate image storage member such as a drum, to receive the first image formed on the photoconductor before transfer to a final copy medium. The latter techniques suffer the disadvantages of increased cost, machine complexity and size and decreased reliability necessitated by the use either of two photoconductive and optical systems or of additional components for intermediate transfer to a final copy medium. Additionally there is the probability of degradation in image quality when an intermediate storage member is used. Furthermore, in some instances the developed images are tackified by use of solvent vapors which are potentially flammable and which require the use of a consumable fluid which must be replaced periodically.

A further duplexing technique utilized in certain commercial electrophotographic machines includes a single photoconductor wherein first fixed images developed sequentially on the first sides of a plurality of copy sheets by an electrophotographic process are collected in an intermediate tray. The copy sheets are then sequentially transported back through the electrophotographic process to develop second fixed images on the second sides of the copy sheets, thus producing duplex copies. The latter "two-pass" process has several disadvantages. Because the first sides of all the copy sheets are developed before development of the second sides of the copy sheets, a duplex copy is not available for inspection until all of the first sides of the copy sheets and one set of the second sides thereof have been developed. In addition, the relatively long paper paths required in passing a copy sheet through the entire electrophotographic process twice greatly increases the possibility of paper jams and other potential copy handling complications. Moreover, environmental conditions of image formation and the physical parameters of the copy sheet may change resulting in images of varying quality on opposite sides of a single sheet and misregistration between images on opposite sides of a copy sheet may also result.

Still another duplex copying technique which may be considered especially relevant to the present invention involves fixing images to both sides of a copy sheet during a single pass through the disclosed electrophotographic processes. U.S. Pat. Nos. 3,506,347; 3,672,765; 3,869,202; and 3,947,270 disclose various embodiments of this technique. In the first patent just listed a first tackified image is formed on a transfer drum, the image is transferred to the first side of a copy sheet, and the sheet is inverted while the first tackified image dries and becomes fixed on the copy sheet. Thereafter, a second tackified copy image is formed on the transfer drum and the copy sheet is fed back into contact with the drum to transfer the second image to the second side of the copy sheet which is then transported to an output tray. In the latter three patents electrophotographic apparatus is disclosed for making copies wherein two images of an original are formed sequentially on a photoconductor, the images are developed and the first developed image is transferred to the first side of a copy sheet. The copy sheet is passed through a fuser to fuse or fix the first transferred image, is turned over and the opposite side of the copy sheet is brought into contact with the second developed image on the photoconductor. The second image is then transferred to the second side of the copy sheet, the copy sheet separated from the photoconductor and the second image fused by means of a second fuser. The disclosed techniques have several disadvantages. Since the first image is fixed before transfer of the second image, either two fusers must be used with attendant increase in cost, power and environmental heat or solvent fixing is used resulting in safety hazards and the inconvenience of handling consumable liquids.

SUMMARY OF THE INVENTION

The present invention alleviates the above and other disadvantages of prior duplex copiers. According to one feature of the invention a single copying process is provided resulting in decreased cost, size and complexity and increased reliability with no image degradation since no intermediate storage member is used. According to another feature of the invention unfixed images are formed on either one or both sides of a copy sheet before fixing of the images thus eliminating the need for a second fuser with attendant decrease in power usage, environmental heat and cost or for solvent fixing thus eliminating safety hazards and the inconvenience of replenishing liquids. Another feature of the invention reduces the length of the copy path from that required for "two-pass" duplexing thus reducing side to side copy quality variability and misregistration and the incidence of paper jams and increasing the production of a finished duplex copy.

In general, according to the present invention there is provided apparatus for producing duplex copies including a movable image transfer member; means for forming first and second transferable images on said transfer member; image transfer means for transferring said images from said transfer member to a copy sheet; and means for moving a copy sheet along a copy sheet inversion path including a plurality of vacuum rollers with at least a first roller located adjacent to said image transfer member and a guide member associated with said vacuum rollers. The vacuum rollers are operable in synchronism with said movable image transfer member and are rotatable in a first direction for attracting by vacuum a copy sheet separating from transfer relationship with said transfer member and to one side of which copy sheet said first transferable image has been transferred, and for moving said copy sheet over said guide member along said inversion path away from said transfer member. The vacuum rollers are then rotatable in a second opposite direction after said copy sheet has been separated from said transfer member so as to invert said copy sheet while said first image is unfixed to move said copy sheet over said guide member along said path toward said transfer member for registering the second side of said copy sheet with said second image on said transfer member at said transfer means.

The invention and its features and advantages, will be set forth and become more apparent in the detailed description of the preferred embodiment presented below.

BRIEF DESCRIPTION OF THE DRAWINGS

In the detailed description of the preferred embodiment of the invention presented below reference is made to the accompanying drawings, in which.

DESCRIPTION OF THE PREFERRED EMBODIMENT

Figure 1:
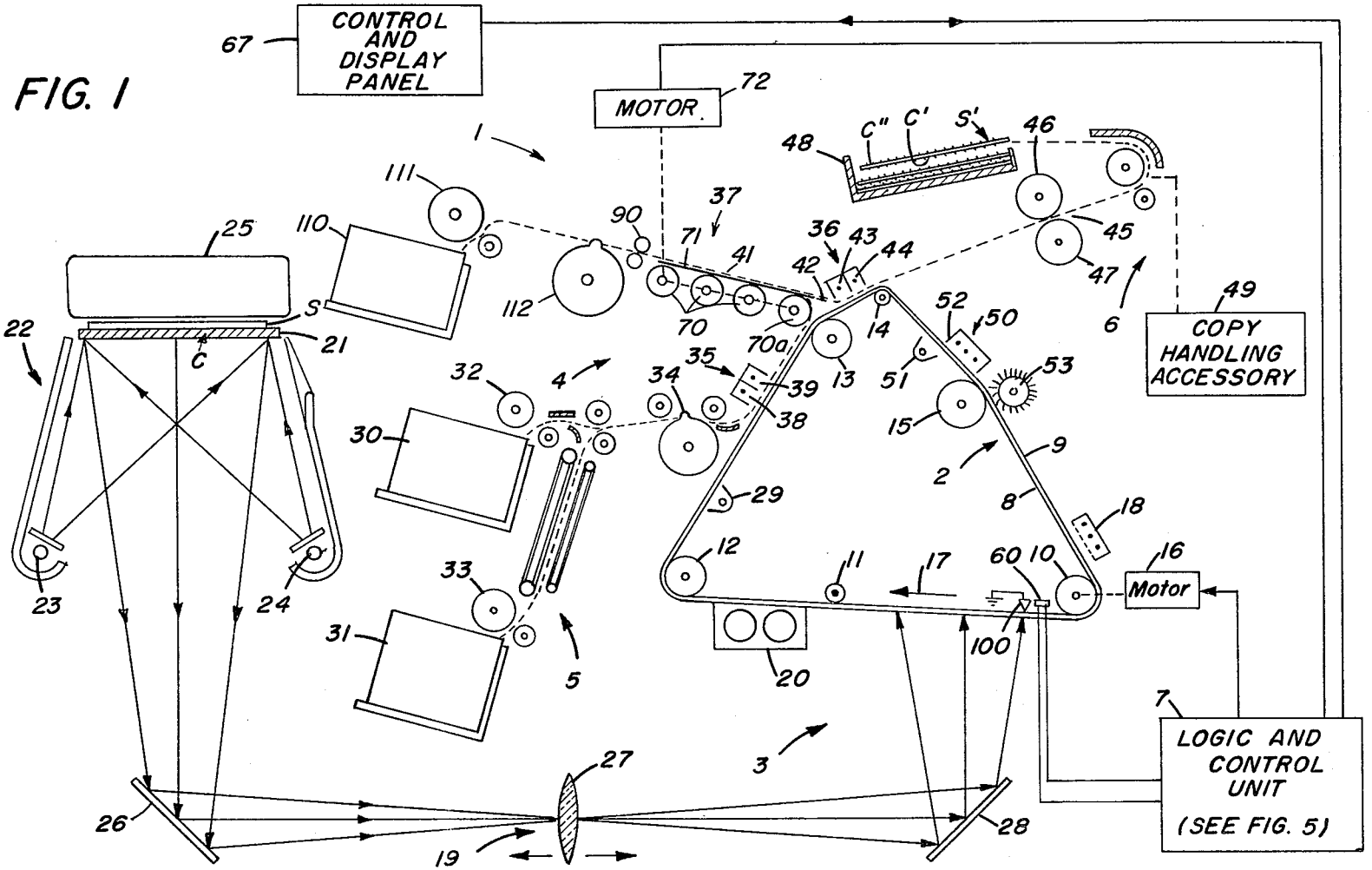
FIG. 1 is a schematic diagram of apparatus incorporating a preferred embodiment of the present invention.

Referring now to the drawings, there is disclosed apparatus for producing duplex copies incorporating a preferred embodiment of the present invention. In FIG. 1 apparatus 1 is shown as an electrophotographic copier which may include, among other elements, an image transfer member 2, an image forming means 3, a copy sheet duplexing station 4, copy sheet input and output sections 5 and 6, respectively, and a logic and control unit 7. Image forming means 3 forms transferable images on image transfer member 2, copy sheet input section 5 supplies copy sheets, copy sheet duplexing section 4 transfers images from transfer member 2 to a copy sheet, copy sheet output section 6 fixes the images to the copy sheet to produce a final copy and delivers the final copy to an output hopper or to a copy handling accessory and logic and control unit (LCU) 7 coordinates the operation of the various elements of apparatus 1 to produce final copies.

The term "sheet" as used in this application is used in reference to a single expanse of thin essentially flat material such as paper or transparencies having two opposed sides. "Simplex" refers to a sheet having only one side having an image; "duplex" refers to a sheet having images on both sides. A "copy sheet" is a sheet which receives simplex or duplex images which are fixed to the copy sheet.

Image Transfer Member and Image Forming Means

Image transfer member 2 may be any member upon which transferable images may be formed and from which the images may be transferred to a copy sheet. In the preferred form of apparatus shown in FIG. 1, member 2 may incorporate a transparent support 8 and a photoconductor 9 backed by a conductive layer (not shown) grounded by grounding brushes 100 and may be trained about transport rollers 10, 11, 12, 13, 14 and 15. Roller 10 is coupled to a drive motor 16 controlled by LCU 7 to move member 2 in a clockwise direction indicated by arrow 17 past various electrophotographic work stations to be described later in greater detail.

Image forming means 3 includes a charging station 18 at which the photoconductor 9 of member 2 receives a uniform electrostatic charge from a suitable device such as a corona charger; an exposing station 19 at which the image of an original to be copied is projected onto electrostatically charged photoconductor 9 of member 2 thereby dissipating the electrostatic charge at the exposed areas of member 2 to form a latent electrostatic image corresponding to the original image; and a developing station 20 at which developing powder including toner particles having an electrostatic charge opposite to that of the latent electrostatic image is brushed over member 2 to develop the latent electrostatic image into a toner image corresponding to the original image.

Charging station 18 is shown as including a corona charger which may be for example be a three-wire grid-controlled type which establishes a uniform negative surface potential on member 2. Other types of known charging devices may also be used such as open wire corona chargers or the like.

Exposing station 19 is shown as including a transparent exposure platen 21 upon which originals to be copied are positioned, an illumination source 22 including flash lamps 23 and 24, and projection optics such as mirrors 26 and 28 and lens 27 which may be movably mounted to permit reduced or enlarged image reproduction. A recirculating feeder 25 may be positioned on the top of platen 21 and may for example take the form of that disclosed in U.S. Pat. No. Re. 27,976 wherein a plurality of original documents having images only on first sides thereof are repeatedly fed in succession from a supply stack to the exposure platen 21 of copier 1 or of that disclosed in Research Disclosure Bulletin, Vol. 156, April, 1977, Item 15671 wherein original documents having images on both sides thereof are repeatedly fed in order to the exposure platen with alternate sides of each sheet being presented to platen 21.

In either case, feeder 25 places a selected side C of a sheet of an original document S with side C facing platen 21. When energized, flash lamps 23 and 24 illuminate side C of document S to produce a light image of the original which is projected onto member 2 by mirrors 26, 28 and lens 27 to produce an electrostatic image corresponding to the original image.

Development station 20 may include a magnetic brush developer which brushes developer including toner particles having an electrostatic charge opposite to that of the latent electrostatic image over member 2. The toner particles adhere to the latent electrostatic image to form a transferable visible toner image which corresponds to the original image.

A post development erase station 29 including an infrared illumination source may be provided to reduce photoconductor fatigue i.e. electrical stress on the photoconductor which decreases its ability to accept or hold an electrostatic charge.

Copy Sheet Input, Duplexing, Simplexing and Output Section

Copy sheet input section 5 includes supplies 30, 31 and 110 of copy sheet S′ of any suitable material such as paper, transparencies or the like. When apparatus 1 is operating in the duplex mode, copy sheets S′ are supplied from the top of either supply 30 or supply 31 by means of oscillating vacuum rollers 32, 33, respectively, to a registration mechanism 34 which registers the first side of copy sheet S' with the first toner image on member 2 at first transfer station 35 and times the movement of copy sheet S' with member 2. When apparatus 1 is operating in the simplex mode, copy sheets S' are supplied from the top of supply 110 by means of oscillating vacuum roller 111 to a registration mechanism 112 which registers the first side of copy sheet S' with the toner image on member 2 at the second transfer station 36 and times the movement of copy sheet S' with member 2.

When apparatus 1 is operating in the duplex mode, image forming means 3 forms first and second transferable toner images on member 2. Copy sheet duplexing-/simplexing section 4 is provided to effect transfer of the toner images to copy sheets and includes first and second image transfer sections 35 and 36 and means 37, located adjacent member 2 between transfer stations 35 and 36, for moving a copy sheet along a copy sheet inversion path.

First transfer station 36 may include a first transfer corona charger 38 which has a negative DC potential applied to its corona wire and a first detack charger 39 which has an AC potential applied to its corona wire. Registration mechanism 34 registers a copy sheet S' with the first toner image formed on member 2 at first transfer station 35 where first transfer charger 38 impresses a negative charge on sheet S' to cause the positively charged first toner image to be transferred from member 2 to a first side C' of sheet S'. Detack charger 39 neutralizes the negative charge on copy sheet S' so that it can be easily separated from member 2.

Means 37 includes a plurality of vacuum rollers 70 with a first roller **70*a* located adjacent member 2 and a guide member 71 associated with rollers 70. Rollers 70 are rotatable in first and second opposite directions by means of motor 72. In the duplex mode, vacuum rollers 70 are rotated in a first direction to attract by vacuum a copy sheet S' separating from transfer relationship with member 2 at the bend formed by roller 13 after the first toner image has been transferred to a first side C' of copy sheet S' at transfer station 35 and to move copy sheet S' along sheet turn around inversion path 41 formed by vacuum rollers 70 and guide member 71. Vacuum rollers 70 are then rotated in a second direction after copy sheet S' has been separated from member 2 to invert sheet S' while the first toner image on side C' is unfixed and to register the second or opposite side C'' of copy sheet S' with the second toner image on member 2 at second transfer station 36 where the second transferable toner image is transferred from member 2 to side C'' of sheet S'. Copy sheet diverter 42 may be provided for assisting in registering sheet S' with the second image on member 2 at second transfer station 36**.

Second transfer station 36 is similar to first transfer station 35 and includes second transfer charger 43 and second detack charger 44. Second transfer charger 43 impresses a negative charge on a sheet S' to transfer a second toner image from member 2 to side C'' of sheet S' and second detack charger 44 neutralizes any charge remaining on sheet S' so that it may be easily separated from member 2.

After transfer of both toner images to sheet S' it is separated from member 2 and directed to output station 6 which includes a fixing means 45 for fixing the unfixed toner images to copy sheet S'. As shown, fixing means 45 may be a roller fuser including heated rollers 46 and 47 for heating and fusing the toner particles to sheet S' to form a final copy. Sheet S' may then be transported to an output tray 48 or to a copy handling accessory 49 such as a finisher such as that disclosed in Research Disclosure Bulletin, Volume 167, March, 1978, Item 16731, which effects straight or offset stacking and stapling of copy sheets or sets of copy sheets.

Copier 1 may be operated in a simplex mode wherein only first images are formed on member 2 and transferred to first sides of copy sheets S'. In such case, a toner image is formed on member 2 by image forming means 3 and the copy sheet S' is supplied by supply 110 and registered with the toner image by registration mechanism 112. Rollers 90 are provided to feed copy sheet S' to means 37. Vacuum rollers 70 are operated in the second (clockwise) direction to move copy sheet S' over guide member 71 into registration with a single toner image in advance of second transfer station 36 at which the toner image is transferred to side C'' of sheet S'.

A cleaning station 50 is provided to effect mechanical and electrical cleaning of photoconductor 9 of web 2. Station 50 includes a cleaning assist erase lamp 51 which exposes the photoconductor to radiation to further reduce any charge remaining from the transfer and detack steps; a cleaning assist charger 52 which impresses an AC charge on photoconductive surface 9 of web 2 to neutralize the charges on untransferred toner particles; and a brush 53 which removes any residual toner from surface 9 and deposits it in a suitable collection container (not shown).

Copy Sheet Inversion Means

Referring now to FIGS. 2, 3A–3D and 4A there is shown in greater detail a preferred form of copy sheet inversion means 37 and the operation of duplexing/simplexing station 4 when operating in the duplex and simplex modes. As shown, means 37 includes a plurality of aligned vacuum rollers 70 and a stationary guide member 71 associated with rollers 70. Rollers 70 are rotatable in synchronism in first and second opposite directions by means of a reversible motor 72. A first roller **70*a* is located substantially adjacent member 2. Rollers 70 are connected to a source of vacuum 73 by means of conduits 74. Rollers 70 may extend the width of means 37** or may comprise a plurality of individual rollers mounted on a common shaft.

Figures 3D, 4A, 4B:
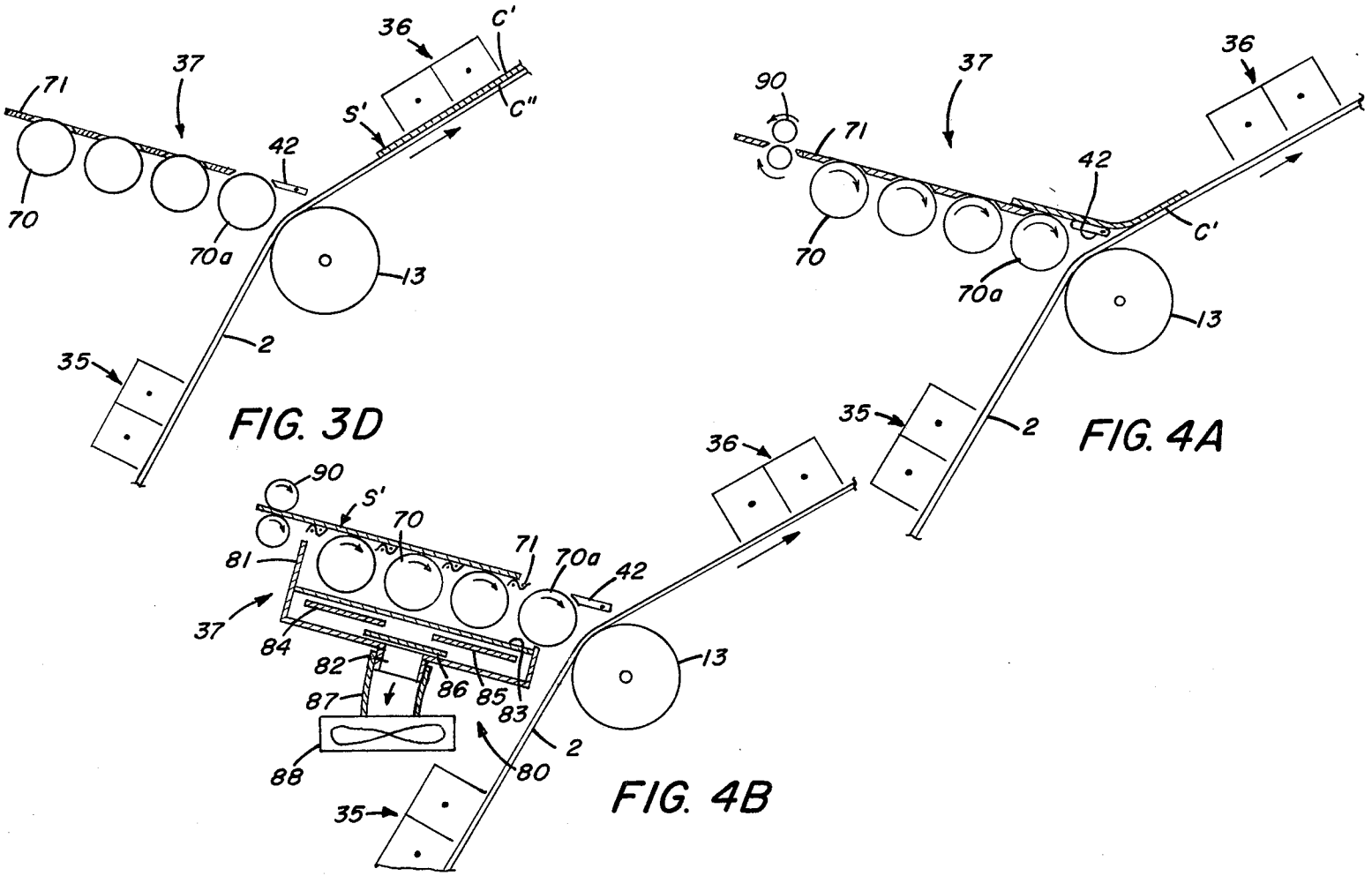
FIG. 4A is a diagrammatic sectional view of the station of FIG. 2 in the simplex mode.
FIG. 4B is a diagrammatic sectional view of another embodiment of the present invention.

Guide member 71 is provided with a plurality of openings 75 through which a portion of rollers 70 extend to contact a copy sheet to move it along copy sheet inversion path 41. Guide member 71 provides a low friction support for a copy sheet and may comprise solid surface or a grid like structure (FIG. 4B).

Figure 2:
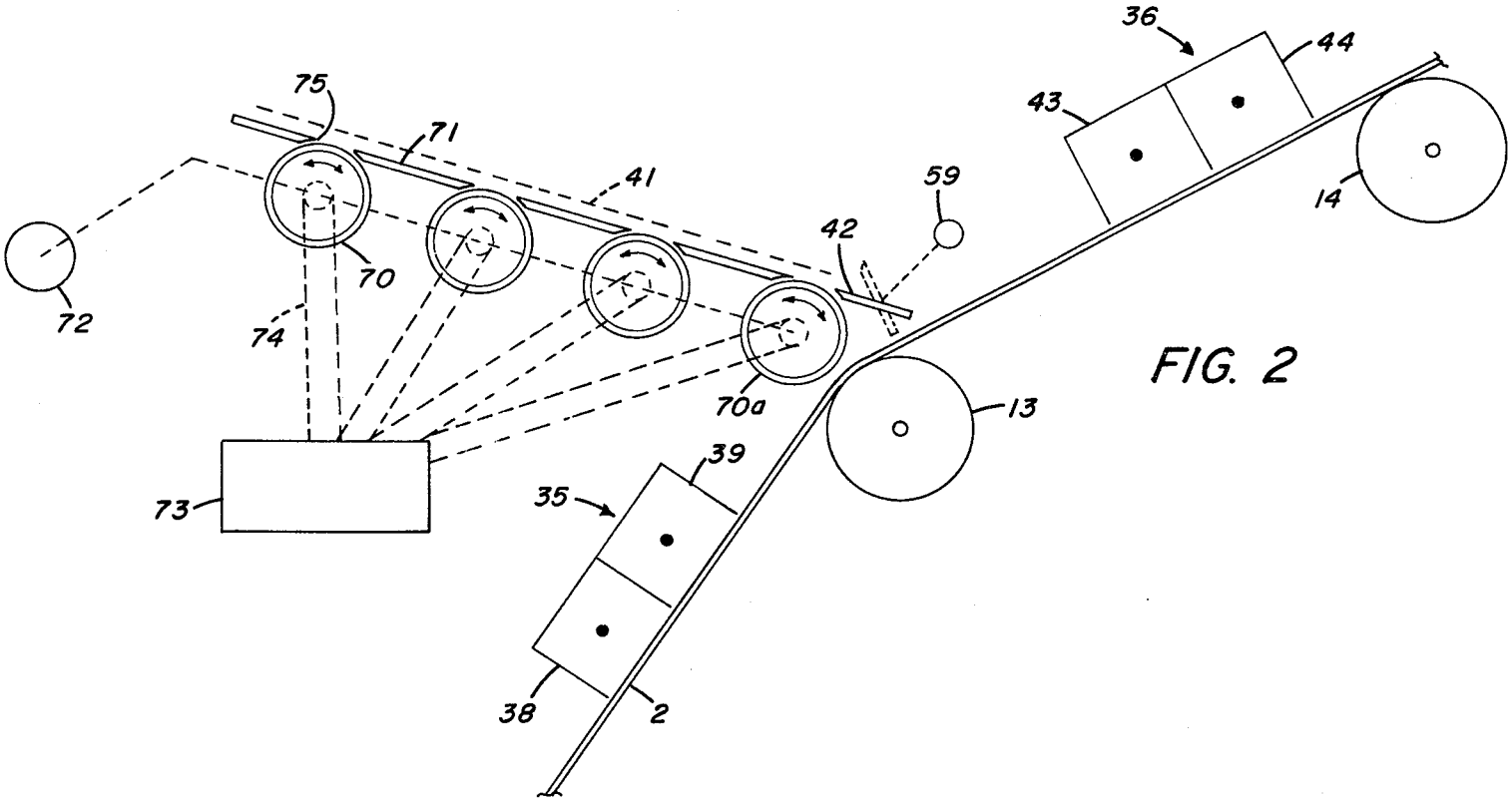
FIG. 2 is a diagrammatic sectional view of the copy duplexing station of the copier of FIG. 1.

Sheet diverter 42 is mounted for movement between a first position as shown in solid lines in FIG. 2 where it is in contact with roller **70*a* of assembly 37 and a second position as shown in dotted lines where it is out of contact with roller 70*a*. Diverter 42 may be moved between such first and second positions by any suitable means such as rotary solenoid 59**.

Figure 3A:
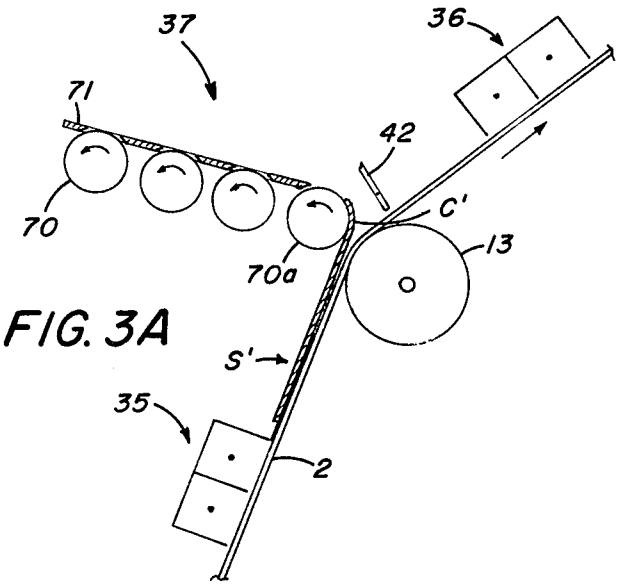
FIGS. 3A–3D are diagrammatic sectional views of the station of FIG. 2 showing different stages during copy sheet inversion in the duplex mode.
Figure 3B:
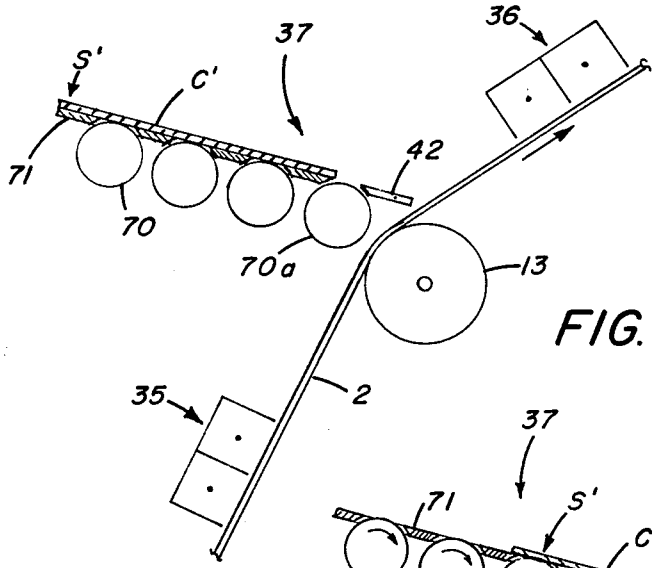

Referring to FIGS. 3A–3D there is shown in more detail the operation of assembly 37 in the duplex mode. In FIG. 3A, vacuum rollers 70 are shown being rotated in a first (counterclockwise) direction at the velocity of member 2 to attract by vacuum copy sheet S' separating from transfer relationship with member 2 at the bend formed by roller 13 after a first toner image has been transferred from member 2 at first transfer station 35 to a first side C' of sheet S'. Diverter 42 has been moved to its second position out of contact with roller **70*a* so that copy sheet S' can be moved along path 41 without interference from diverter 42. In FIG. 3B, copy sheet S' is shown completely separated from member 2, the counterclockwise rotation of rollers 70 has been halted and diverter 42 has been moved to its first position in contact with roller 70***a*. Since the unfixed first toner image transferred to side C' of copy sheet S' is facing outwardly there is no disturbance of such image and thus no need for the fixing of the first image to sheet S'.

Figure 3C:
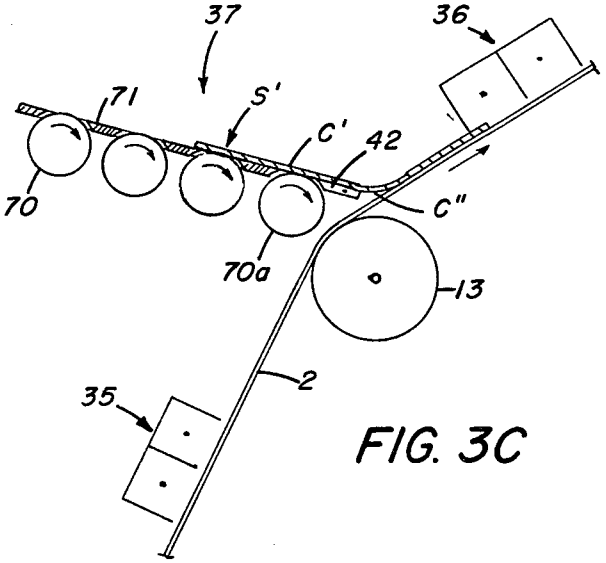

As shown in FIG. 3C, rollers 70 are rotated in a second (clockwise) direction at the velocity of member 2 to register the second unimaged side C'' of copy sheet S' with the second toner image on web 2 at second transfer station 36. Diverter 42 is shown in substantial contact with roller 70*a* to effect a guide path for sheet S' from means 37 to member 2.

FIG. 3D shows sheet S' after it has cleared means 37 and diverter 42 as it passes under transfer station 36 which transfers the second toner image on member 2 to side C'' of copy sheet S'. Subsequently, diverter 42 would be moved to the position shown in FIG. 3A, the direction of rollers 70 would be reversed and the sequence of FIGS. 3A–3D would be repeated with respect to the next copy sheet S'.

Referring now to FIG. 4A, there is shown station 4 as it is operated in the simplex mode. Rollers 90 are provided to feed a copy sheet S' from a supply (not shown) to means 37. Rollers 70 are rotated in the second (clockwise) direction to move sheet S' over grid 71' into registration with a single toner image formed on member 2 in advance of second transfer station 36 at which the toner image is transferred to side C' of sheet S'.

FIG. 4B shows another embodiment of the present invention. As shown, copy sheet inversion means 37 includes rollers 70, air pervious guide member 71' and air flow source 80. Air pervious member 71' may comprise a grid to facilitate air flow through it. Source 80 includes a housing 81, having an outlet 82, a honeycombed member 83, and baffle members 84, 85 and 86. Conduit 87 connects outlet 82 of housing 81 to an air mover such as fan 88.

In the duplex mode, the embodiment shown in FIG. 4B inverts the copy sheet S' in the same manner as shown in FIGS. 3A–3D. Fan 88 draws air through air pervious member 71', past rollers 70, through member 83, past baffles 84, 85 and 86 and through outlet 82 and conduit 87 to hold a copy sheet S' against member 71' to prevent buckling of the sheet as it is moved along the sheet inversion path by rollers 70.

In the simplex mode, rollers 90 are provided to feed a copy sheet S' from a supply (not shown) to means 37.

Logic and Control Unit

Figure 5:
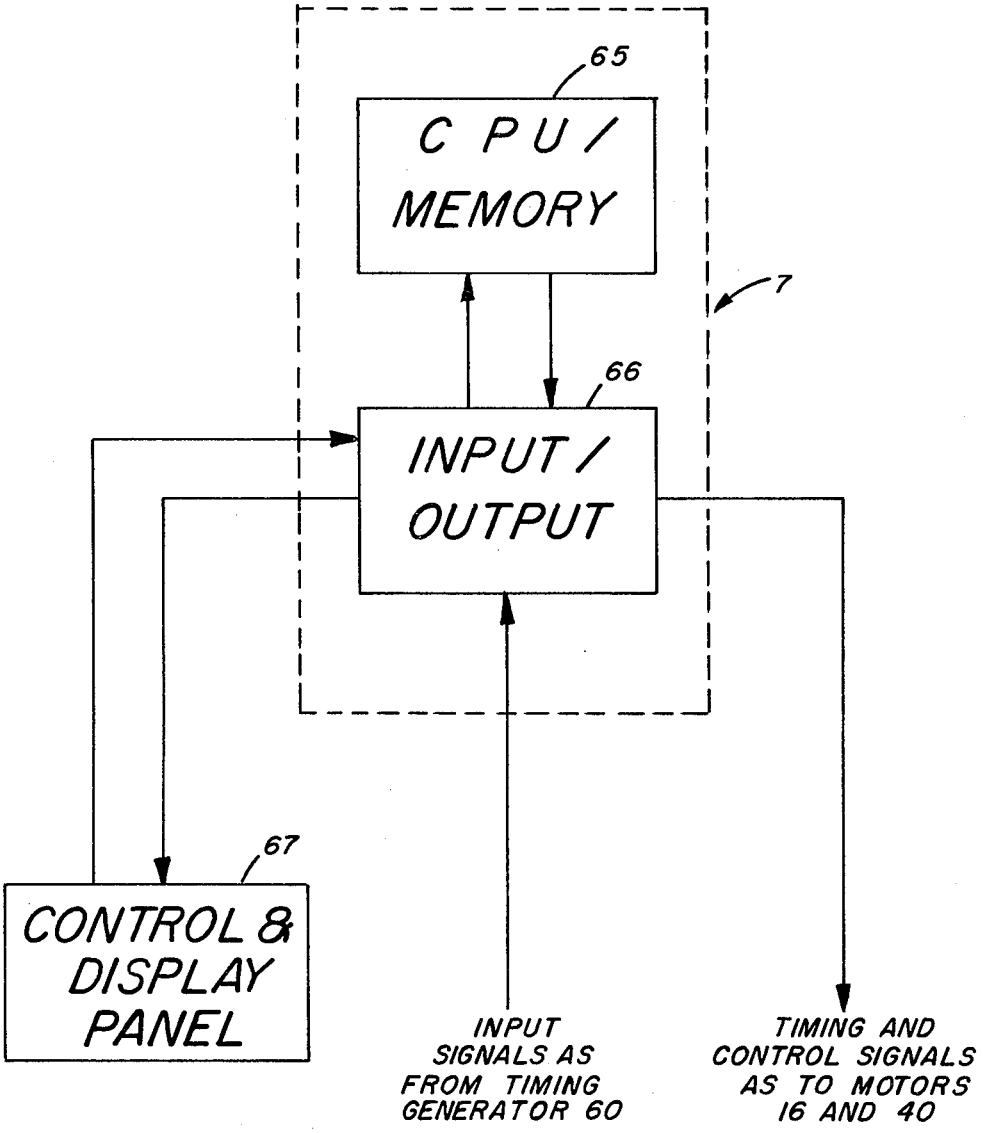
FIG. 5 is a block diagram of the control of FIG. 1.

As shown in FIG. 1, and more particularly in FIG. 5, operation of copier 1 and its related accessories such as feeder 25 and copy handling accessory 49 is monitored and controlled by a digital microprocessor incorporated in logic and control unit (LCU) 7. LCU 7 may include a central processing unit and memory module 65 and an input/output module 66. Module 65 includes a central processing unit (CPU) which processes data in digital format, a program memory such as a read only memory (ROM) which stores basic logic and control subroutines and a random access memory (RAM) which is used for temporary memory and for maintaining a short term account of the flow of original documents and of copies being processed. Module 66 provides all of the control signals and data bus connections to communicate with the CPU, ROM and RAM of module 65.

A control and display panel 67 is provided on copier 1 and includes operator selectable switches and controls for such functions as number of copies desired, choice of simplex or duplex copying, etc., and also includes displays to indicate information such as number of copies selected, number of copies produced, jam conditions in the copier or its accessories, etc. Input signals to LCU 7 are derived from various switches, sensors and the like which monitor copier operation, track the passage of copy sheets, etc., and from a timing generator 60. As disclosed in U.S. Pat. No. 3,914,047, member 2 may include a series of perforations along an edge thereof which are sensed by a sensor such as a piezoelectric or optic sensor 60. The perforations provide a means for generating timing signals which are related to the movement of web 2 and which are used to synchronize the various mechanisms of copier 1 and its accessories with the location of the images formed on web 2.

Output signals from LCU 7 control the various work stations of the copier including turning drive motor 16 on and off, initiating flash lamps 23 and 24 and controlling the direction acceleration and speed of motor 40 to effect operation of means 37 during duplex and simplex operation.

The invention has been described in detail with particular reference to preferred embodiments thereof but it will be understood that variations and modifications can be effected within the spirit and scope of the invention.

What is claimed is:

1. Apparatus for producing simplex or duplex images on a copy sheet, said apparatus comprising:

a movable photoconductive member;

means for forming unfixed transferable toner images on said photoconductive member;

first and second toner image transfer stations located in transferable relationship with said photoconductive member for transferring said images from said photoconductive member to a copy sheet;

means for moving a copy sheet along a copy sheet path located between said first and second transfer stations and including a plurality of vacuum rollers including at least a first roller located adjacent to said photoconductive member and a guide member associated with said vacuum rollers;

said vacuum rollers being operable in synchronism with said movable photoconductive member and being rotatable when duplex images are produced on a copy sheet in a first direction for attracting by vacuum a copy sheet separating from transfer relationship with said photoconductive member and to one side of which copy sheet a first transferable image has been transferred at said first transfer station, and for moving said copy sheet over said guide member along said path away from said photoconductive member and being rotatable in a second opposite direction after said copy sheet has been separated from said photoconductive member so as to invert said copy sheet while said first image is unfixed to move said copy sheet over said guide member along said path toward said photoconductive member for bringing the second side of said copy sheet into transferable relationship with said second image on said photoconductive member at said second transfer station and when a simplex image is produced on a copy sheet in said second direction to move a copy sheet over said guide member toward said photoconductive member to bring a side of said copy into transferable relationship with an image on said photoconductive member at said second image transfer station.

2. The apparatus of claim 1 wherein said plurality of vacuum rollers are disposed in substantial alignment and said guide member is stationary.

3. The apparatus of claim 1 wherein said guide member includes an air permeable member.

4. The apparatus of claim 3 wherein said air permeable member comprises a grid member and wherein said vacuum rollers are so disposed with respect to said grid member that portions of said rollers are substantially coextensive with said grid member to contact a copy sheet to move it along said sheet path.

5. The apparatus of claim 1 wherein said copy sheet path includes a copy sheet diverter located between said guide member and said photoconductive member for assisting in bringing the copy sheet into transferable relationship with said photocondutive member at said second transfer station.

6. In apparatus for producing simplex or duplex images on a copy sheet, said apparatus including a movable image transfer member and first and second image transfer means for transferring images formed on said image transfer member to a copy sheet, the improvement comprising:

means for defining a copy sheet path located between said first and second transfer means and including a plurality of vacuum rollers rotatable in first and second opposite directions with at least a first roller located adjacent to said image transfer member and a guide member associated with said vacuum rollers; and means for rotating said rollers in synchronism with said movable image transfer member when duplex images are produced on a copy sheet in said first direction for attracting by vacuum a copy sheet separating from transfer relationship with said transfer member and to one side of which copy sheet a first transferable image has been transferred by said first transfer means, and for moving said copy sheet over said guide member along said path away from said transfer member and in said second direction after said copy sheet has separated from said transfer member to move said copy sheet over said guide member along said path toward said transfer member to bring the other side of said copy sheet into transferable relationship with a second image on said image transfer member at said second transfer means, and when a simplex image is produced on a copy sheet in said second direction to move a copy sheet over said guide member toward said transfer member to bring a side of said copy sheet into transferable relationship with a simplex image on said image transfer member at said second image transfer means.

7. The improvement of claim 6 wherein said guide member is a substantially rigid stationary member and said vacuum rollers are disposed in substantial alignment.

8. The improvement of claim 7 wherein said guide member is an air permeable member.

9. The improvement of claim 7 wherein said guide member comprises a substantially planar grid member and wherein said vacuum rollers are so disposed with respect to said grid member that a portion of said rollers are substantially coextensive with said grid member.

* * * * *